US006802775B2

(12) United States Patent
Baerlocher et al.

(10) Patent No.: US 6,802,775 B2
(45) Date of Patent: Oct. 12, 2004

(54) GAMING DEVICE HAVING AN ELEMENT AND ELEMENT GROUP SELECTION AND ELIMINATION BONUS SCHEME

(75) Inventors: Anthony J. Baerlocher, Reno, NV (US); Bayard S. Webb, Sparks, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/463,136

(22) Filed: Jun. 17, 2003

(65) Prior Publication Data

US 2003/0224848 A1 Dec. 4, 2003

Related U.S. Application Data

(63) Continuation of application No. 09/689,381, filed on Oct. 12, 2000, now Pat. No. 6,585,591.

(51) Int. Cl.[7] ..... A63F 9/24
(52) U.S. Cl. ..... 463/16
(58) Field of Search ..... 463/16–20, 25–28; 273/143 R, 138.1, 121 B, FOR 121 B, FOR 138 A, FOR 143 R

(56) References Cited

U.S. PATENT DOCUMENTS

| | | | |
|---|---|---|---|
| 4,695,053 A | | 9/1987 | Vazquez, Jr. et al. |
| 5,788,573 A | | 8/1998 | Baerlocher et al. |
| 5,823,874 A | | 10/1998 | Adams |
| 5,848,932 A | | 12/1998 | Adams |
| 5,882,261 A | | 3/1999 | Adams |
| 5,911,418 A | | 6/1999 | Adams |
| 5,947,820 A | | 9/1999 | Morro et al. |
| 6,015,346 A | | 1/2000 | Bennett |
| 6,089,976 A | | 7/2000 | Schneider et al. |
| 6,089,978 A | | 7/2000 | Adams |
| 6,093,102 A | | 7/2000 | Bennett |
| 6,102,798 A | | 8/2000 | Bennett |
| 6,126,542 A | | 10/2000 | Fier |
| 6,159,098 A | | 12/2000 | Slomiany et al. |
| 6,162,121 A | | 12/2000 | Morro et al. |
| 6,168,520 B1 | | 1/2001 | Baerlocher et al. |
| 6,174,235 B1 | | 1/2001 | Walker et al. |
| 6,190,255 B1 | | 2/2001 | Thomas et al. |
| 6,364,766 B1 | * | 4/2002 | Anderson et al. ..... 463/16 |
| 6,592,457 B1 | * | 7/2003 | Frohm et al. ..... 463/16 |

FOREIGN PATENT DOCUMENTS

| | | |
|---|---|---|
| EP | 0874337 A1 | 10/1998 |
| EP | 0945837 A2 | 9/1999 |
| EP | 0984409 A2 | 3/2000 |

OTHER PUBLICATIONS

Jackpot Party Brochures and Articles, WMS Gaming, Inc., 1998.
Piggy Banking and Big Bang Piggy Banking Brochures, WMS Gaming, Inc., undated.
Top Dollar Brochure, IGT.

* cited by examiner

*Primary Examiner*—Michael O'Neill
(74) *Attorney, Agent, or Firm*—Bell, Boyd & Lloyd LLC

(57) ABSTRACT

A method and apparatus of a gaming device having an element and element group selection and elimination bonus scheme for randomly determining an award. The gaming device provides a selection and elimination sequence of an element from a group. The bonus scheme continually selects and eliminates a next element from a successive group at least containing the previously selected element. The bonus scheme awards a player when the game ends.

56 Claims, 16 Drawing Sheets

FIG.11

| | | | | | |
|---|---|---|---|---|---|
| | 10 | 100 | 20 | 5 | |
| 10 | 50 | 90 | 30 | 100 | 20 |
| 90 | 30 | 5 | 100 | 20 | 50 |
| 100 | 90 | 20 | 5 | 10 | 30 |
| 20 | 5 | 50 | 10 | 30 | 100 |
| | 20 | 30 | 50 | 90 | |
| | 100 | 10 | 90 | 50 | |

146

FIG.12

| | | | | | | |
|---|---|---|---|---|---|---|
| 100 | 10 | 50 | 30 | 20 | 90 | 5 |
| 10 | 5 | 100 | 50 | 5 | 20 | 30 |
| 50 | 100 | 90 | 10 | 50 | | |
| 30 | 50 | 10 | 20 | 100 | | |
| 20 | 5 | 50 | 100 | 30 | | |
| 90 | 20 | | | | | |
| 5 | 30 | | | | | |

148

GAMING DEVICE HAVING AN ELEMENT AND ELEMENT GROUP SELECTION AND ELIMINATION BONUS SCHEME

PRIORITY CLAIM

This application is a continuation of and claims the benefit of U.S. patent application Ser. No. 09/689,381, filed Oct. 12, 2000 now U.S. Pat. No. 6,585,591.

CROSS-REFERENCE TO RELATED APPLICATIONS

This application is related to the following commonly-owned co-pending patent applications: "GAMING DEVICE HAVING AN INDICATOR SELECTION WITH PROBABILITY-BASED OUTCOME BONUS SCHEME," Ser. No. 09/605,809, now U.S. Pat. No. 6,315,664; "GAMING DEVICE HAVING APPARATUS AND METHOD FOR PRODUCING AN AWARD THROUGH AWARD ELIMINATION OR REPLACEMENT," Ser. No. 09/686,283, now U.S. Pat. No. 6,413,161; "GAMING DEVICE HAVING APPARATUS AND METHOD FOR PRODUCING AN AWARD THROUGH AWARD ELIMINATION OR REPLACEMENT," Ser. No. 10/172,870, "GAMING DEVICE HAVING APPARATUS AND METHOD FOR PRODUCING AN AWARD THROUGH AWARD ELIMINATION OR REPLACEMENT," Ser. No. 10/173,283, now U.S. Pat. No. 6,575,830; "GAMING DEVICE HAVING APPARATUS AND METHOD FOR PRODUCING AN AWARD THROUGH AWARD ELIMINATION OR REPLACEMENT," Ser. No. 10/386,891, "GAMING DEVICE HAVING RELATED MULTI-GAME BONUS SCHEME," Ser. No. 09/688,972, now U.S. Pat. No. 6,634,943; "GAMING DEVICE HAVING RELATED MULTI-GAME BONUS SCHEME," Ser. No. 10/662,496, "GAMING DEVICE HAVING RELATED MULTI-GAME BONUS SCHEME," Ser. No. 10/662,929, "GAMING DEVICE HAVING A RANDOMLY SELECTED SYMBOL ELIMINATION GAME," Ser. No. 10/236,660, "METHOD AND APPARATUS FOR DETERMINING A GAMING DEVICE AWARD," Ser. No. 10/644,309, "GAMING DEVICE WITH A BONUS SCHEME HAVING REPEATED SELECTION OF VALUE SETS WITH OPTION TO SAVE VALUES," Ser. No. 10/231,639, "GAMING DEVICE HAVING AN INDICATOR SELECTION WITH PROBABILITY-BASED OUTCOME BONUS SCHEME," Ser. No. 09/981,163, "GAMING DEVICE HAVING AN INDICATOR SELECTION WITH PROBABILITY-BASED OUTCOME," Ser. No. 09/990,693, now U.S. Pat. No. 6,676,516; "GAMING DEVICE WITH A BONUS SCHEME HAVING REPEATED SELECTION OF VALUE SETS WITH OPTION TO SAVE VALUES," Ser. No. 09/684,533, now U.S. Pat. No. 6,464,582.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an element and element group selection and elimination bonus scheme.

BACKGROUND OF THE INVENTION

Many existing gaming machines, such as, traditional slot machines, include bonus schemes. Typically, a bonus round of the bonus scheme begins when the player reaches a bonus triggering event in the primary game of the gaming device. In slot machines that employ reels, the triggering event generally occurs when the player reaches a predetermined combination of symbols on the reels. In general, the bonus round provides the player with an opportunity to gain and accumulate a bonus value or award before the bonus round ends or terminates.

For example, a player may receive a relatively high bonus value for selecting a certain symbol and a relatively low bonus value for selecting another symbol. The bonus value awarded for the same symbol can also vary. For instance, if a player chooses a symbol on one occasion, the game may award a certain bonus value, and if the player chooses the same symbol on another occasion, the game may award a different bonus value. The bonus values which are awarded to a player are predetermined by a computer using known data or by randomly generating data based upon one or more mathematical formulas. For any single symbol or combination of symbols, these techniques often derive bonus values from a single set of possible bonus values. For example, existing gaming devices utilize pay tables which include various sets of values with each set corresponding to a predetermined combination of symbols. European Patent Application No. EP 0 945 837 A2 filed on Mar. 18, 1999 and assigned on its face to WMS Gaming, Inc. discloses a bonus scheme generally of this type.

To increase player enjoyment and excitement, it is desirable to provide players with gaming devices having new bonus schemes.

SUMMARY OF THE INVENTION

The present invention overcomes the above shortcomings by providing a gaming device and preferably a gaming device having an element and element group selection and elimination bonus scheme which provides an apparatus and method for randomly determining a plurality of awards for the player. The gaming device, and particularly the bonus scheme, performs a number of sequencing events to randomly select and eliminate elements and element groups or groups of elements. The game preferably awards a player bonus values until the game ends upon the selection of an eliminated element.

The gaming device provides at least one selection, elimination and preferably award sequence of events. Each of the successive selection sequences involve the selection of an element or elements from a group not previously eliminated and at least containing the previously selected element. If the successively or next selected element is not an eliminated element, then the game preferably awards another bonus value. The gaming device repeats the selection, elimination and preferably award sequencing until a previously eliminated element is selected.

The gaming device, and particularly the bonus scheme of the gaming device, can include a variety of different configurations to enhance the player's entertainment and enjoyment during the selection, elimination and award sequencing of the bonus scheme.

In one embodiment, the present invention preferably provides a grid which includes a plurality of rows and columns. Each row and column is a group of elements. Each of the squares, rectangles or other like shapes of the grid hereafter referred to as positions. Each position is an element and created by the rows and columns are associated with an award.

When the player selects a game initiator, the present invention begins by randomly picking a position and its associated award from one row of the grid, preferably the top row. The present invention can alternatively start with any row or column of the grid. The game preferably provides a sequence that randomly picks a position for creating player excitement and enjoyment. In a preferred embodiment the game scrolls back and forth across the top row before selecting any of the positions and its associated award. Thereafter, the game prohibits the player from obtaining an award from the top row of positions (i.e., the group of elements in the top row). The game ends if in a subsequent position selection the game randomly stops on or selects a top row position or element. The game therefore suitably marks each of the positions of the top row as spent or exhausted. In one embodiment, the game distinguishes between marked and unmarked positions by lighting each unmarked position with a different color than the marked positions, i.e., spent or exhausted positions.

The game then randomly selects a position and a corresponding award from the column that contains the position or element which was selected from the top row. In selecting a position from the column, the game preferably employs the same display or sequence used in the top row in conjunction with selecting the top row position. After randomly selecting a position from the column, the game preferably suitably marks the entire column as spent or exhausted. It should be appreciated that if the game randomly selects the position of the top row of the column, the game ends because that position is spent or exhausted. If the game selects any other position, the player wins its associated award and the game preferably accumulates the award with any previous awards.

Assuming the game does not select the position of the spent top row, each of the positions of the previously selected and marked row and column are marked or spent and the game proceeds to randomly select a position and corresponding award from a new or next selected row which contains the position that was selected from the previously selected column. The game preferably employs the same display or sequence as described above.

If the game selects the position from the spent or marked column, the game ends. If not, the games awards the value associated with the next selected position and preferably accumulates the award with any previous awards. The present invention proceeds in this manner by alternating between unmarked rows and columns to randomly select a position from its respective row or column until the game selects a position belonging to a spent, exhausted, eliminated or marked row or column. The player wins the accumulation of awards from each of the selected positions, preferably, but not limited to, including the selected position from a marked row or column. It should be appreciated that successive random selections of the present invention have a decreasing chance of generating an award for the player.

While the present invention preferably employs a square or rectangle grid, the present invention can employ any shaped grid that enables the selection sequence as detailed above or like selection sequence to randomly select an award. The present invention can employ any type of display including, but not limited to, a plate of glass covering an array of lights or any known video monitor. The present invention preferably displays all available awards to the player at all times during the game. The game can alternatively employ one of a plurality of reveal sequences, wherein the game does not display all values at all times. The present invention also contemplates varying amounts of player interaction including, but not limited to: no player interaction (game automatically begins and ends); the player selecting a start button once, wherein the game automatically runs its course; the player initiating each random generation of a selected position; and the player initiating each selection or generation sequence and also separately initiating a sequence which randomly selects a position, wherein it appears that the player has control over the position selected.

The present invention is not limited to the rows and columns of the grid configuration as discussed above. In another embodiment, the groups are defined by a circular boundary or border that each contain a number of elements.

It is therefore, an object of the present invention to provide a gaming device having an element and element group selection and elimination bonus scheme.

It is a further object of the present invention to provide a gaming device having a position, row and column selection and elimination bonus scheme.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 11 is a top plan view of another embodiment of the grid display of the bonus scheme of the present invention;

FIG. 12 is a top plan view of another embodiment of the grid display of the bonus scheme of the present invention;

DETAILED DESCRIPTION OF THE INVENTION

Gaming Device and Electronics

Figure 1A:
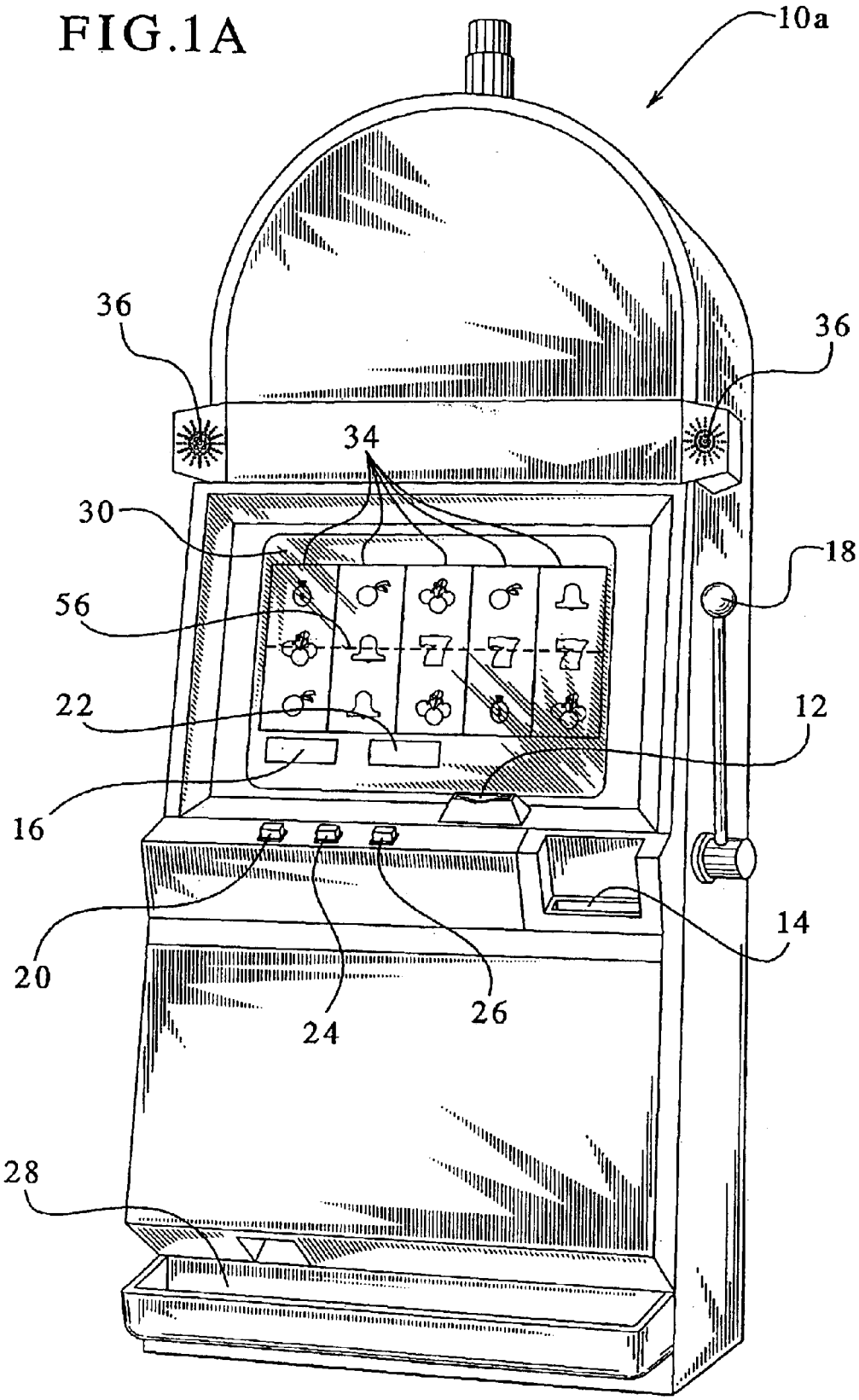
FIG. 1A is a perspective view of one embodiment of the gaming device of the present invention.
Figure 1B:
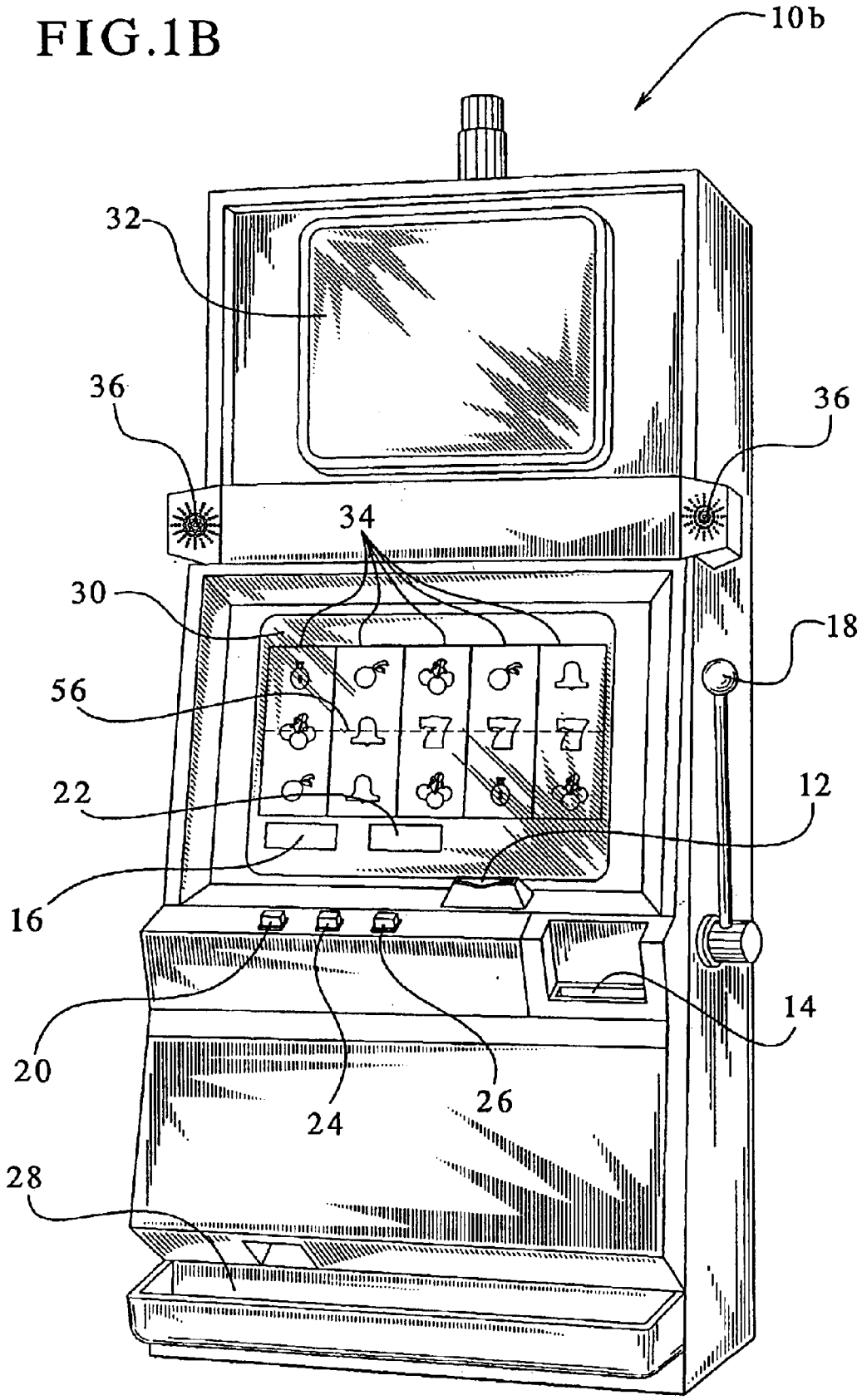
FIG. 1B is a perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device, Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
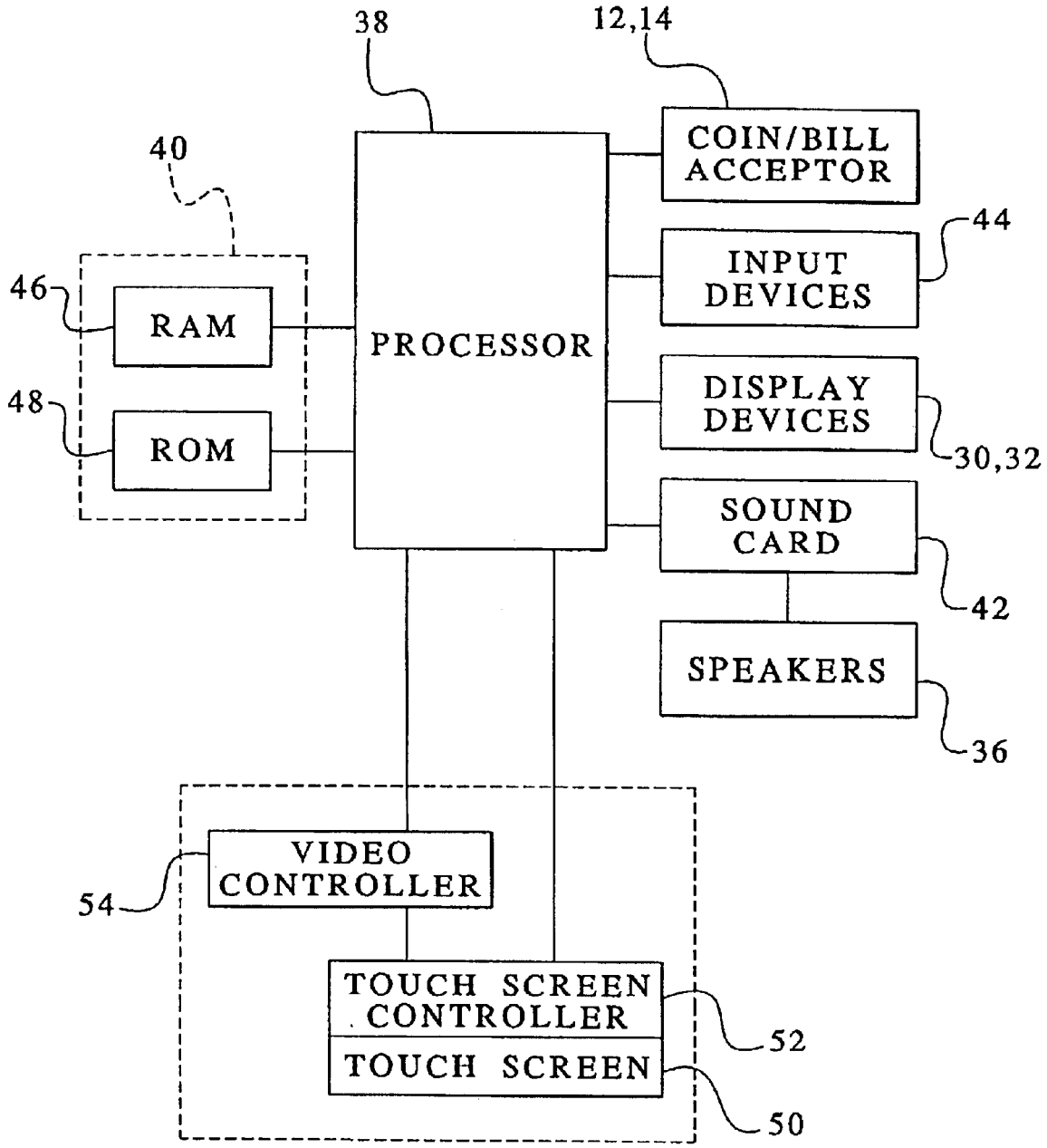
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

Bonus Scheme

If a player achieves a bonus triggering or qualifying condition while playing the game, the gaming device 10 automatically begins the bonus round of the present invention. At the beginning of the bonus round, the game exhibits or displays one or more symbols, sounds, indicators, selections, visual or audio representations or other graphical representations. The bonus scheme may involve a variety of game scenarios which involve awarding bonus values to a player upon the occurrence of certain events. The computer of the gaming device determines what a game exhibits or displays, game scenarios, the object of the game, how the game is played and the various events which occur in the game. The gaming device utilizes a monitor to display or exhibit the game scenarios, including the bonus round. The monitor includes a video monitor for displaying a video display of the game scenarios. However, the present invention is not limited to the use of a video monitor and can include any suitable display for exhibiting the game scenarios.

The present invention provides a bonus scheme that includes at least one selection, elimination and preferably award sequence of events. Each of the successive selection sequences involve the selection of an element or elements from a group not previously eliminated and at least containing the previously selected element. If the successively selected element is not an eliminated element, then the game preferably awards another bonus value. The gaming device repeats the selection, elimination, and preferably award sequencing until a previously eliminated element is selected. The present invention provides a plurality of groups that each contain at least one element and can include a variety of different configurations to enhance the player's entertainment and enjoyment during play.

As shown in FIGS. 3 to 6, one embodiment of the bonus scheme of the present invention is displayed as a grid 100 that has a plurality of rows 102 and columns 104 wherein each row 102 and column 104 has a plurality of positions 106. Generally, each row and each column is a group of elements and each position is an element.

Figure 3:
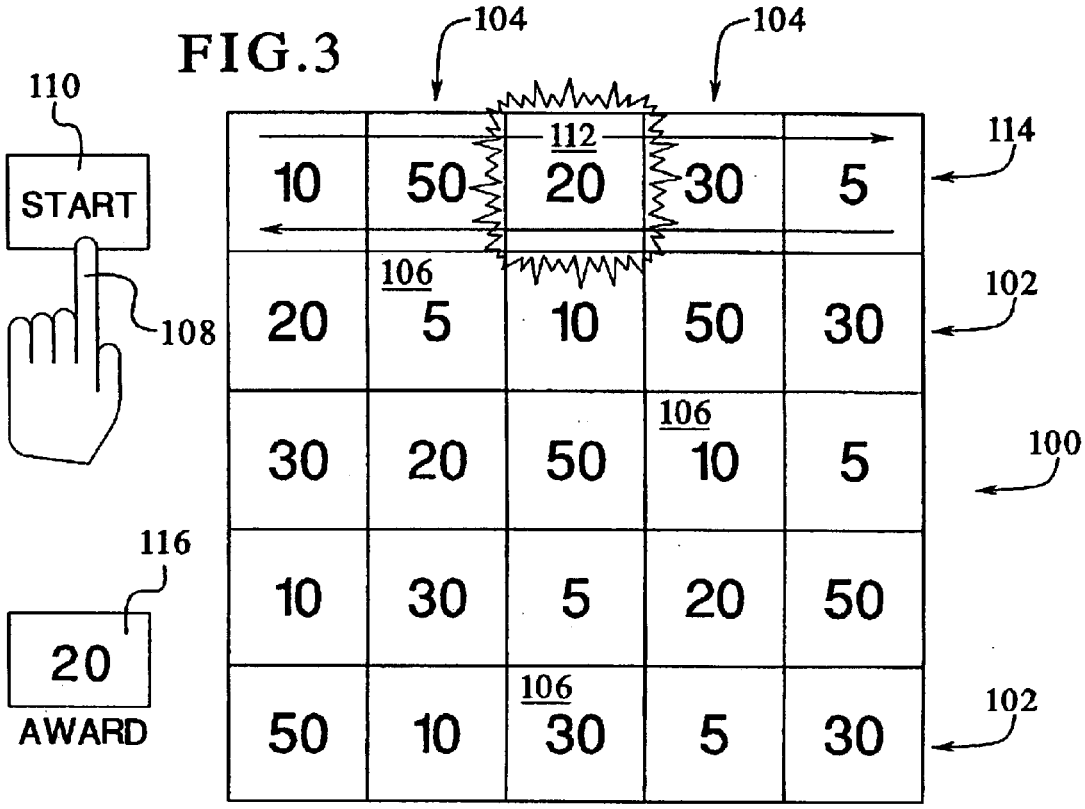
FIG. 3 is a top plan view of the row and column grid of one embodiment of the bonus scheme of the present invention.

As illustrated in FIG. 3, the bonus round begins preferably when the player 108 depresses a start button 110 or other like triggering event. The game randomly selects a first position 112 from a first row 114 of the grid 100. However, the game is not limited to selecting the first position 112 from the first row 114. The game may select a first position 112 from any of the columns 104 and rows 102 that makeup the grid 100.

The game makes a series of passes along the first row 114 prior to selecting the first position 112. For example, the game can make a series of four passes and selects the first position 112 on the next or select pass. The game is not limited to the number or series of passes that it makes prior to selecting a position 106, such as, the first position 112. In order to facilitate excitement, the positions are randomly highlighted or highlighted in a predetermined order as displayed on the monitor (not shown) when the game makes a series of passes prior to selecting a position. The game utilizes a light box associated with the positions in order to highlight the positions. However, the game is not limited to the use of a light box and can include a variety of different and suitable highlighting mechanisms.

When the selected position is chosen, the selected position, such as the selected position 112, remains highlighted to designate its selection as further illustrated in FIG. 3. The highlighted and selected first position 112 corresponds to or is associated with an award or bonus value of 20. The bonus value of 20 is identified on an award display 116 or other like member for the player to monitor during the bonus round as illustrated in FIG. 3.

Figure 4:
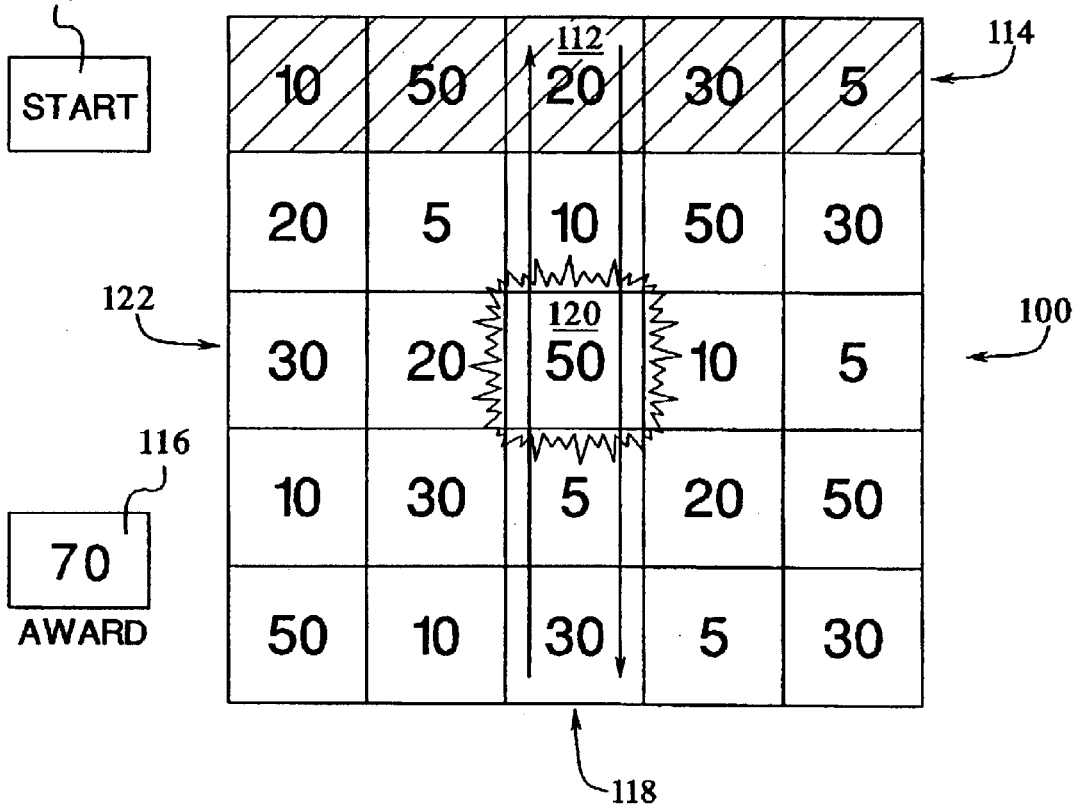
FIG. 4 is a top plan view of the grid of FIG. 3 after the random selection of an award from a top row or first selected row of the grid.

Once the first position 112 is selected, the entire first row 114 is spent, exhausted or eliminated and marked as illustrated in FIG. 4. By marking, the gaming device highlights the entire row or column (i.e., the group) containing the selected position (i.e. the selected element), such as the first row 114 as further illustrated in FIG. 4. However, the present invention is not limited to marking by highlighting and can utilize a variety of different and suitable marking techniques.

The game next makes a series of passes along a first column 118 to randomly select a second position 120. The first column 118 includes the first or previously selected position 112. As further illustrated in FIG. 4, the position that corresponds to a bonus award of 50 was selected and highlighted. The bonus value of 50 was added to the previously selected bonus value and a cumulative bonus value of 70 is displayed in the award display 116 as illustrated in FIG. 4.

Figure 5:
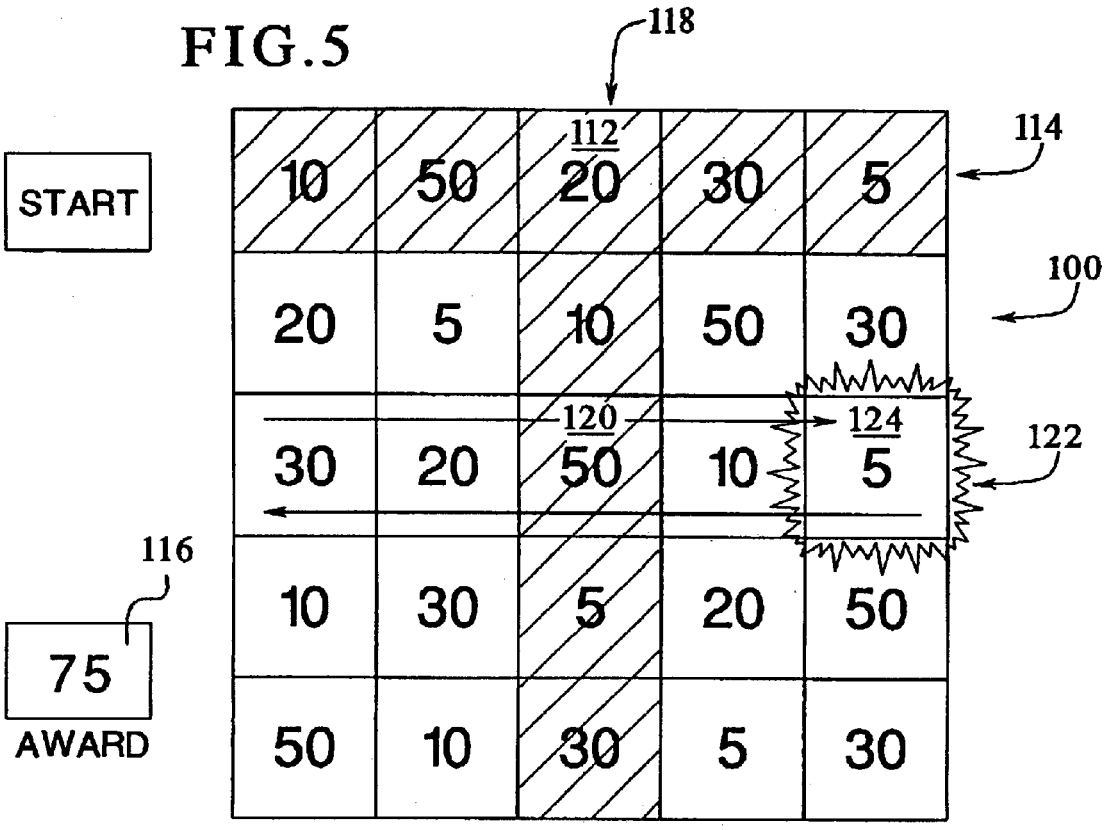
FIG. 5 is a top plan view of the grid of FIG. 3 after the random selection of an award from a first selected column.

When the position 120 of the first column 118 is selected, the entire first column is spent or exhausted and marked as further illustrated in FIG. 5. The game continues and makes a series of passes to randomly select a next position along a second row 122 that includes the previously selected position 120 from the first column 118. The selected position 124 of the second row 122 is highlighted and corresponds to a bonus value of 5 as illustrated in FIG. 5. The newly awarded bonus value of 5 is added to the bonus value cumulative total for a new cumulative total of 75 as displayed in the award display 116 as illustrated in FIG. 5.

Figure 6:
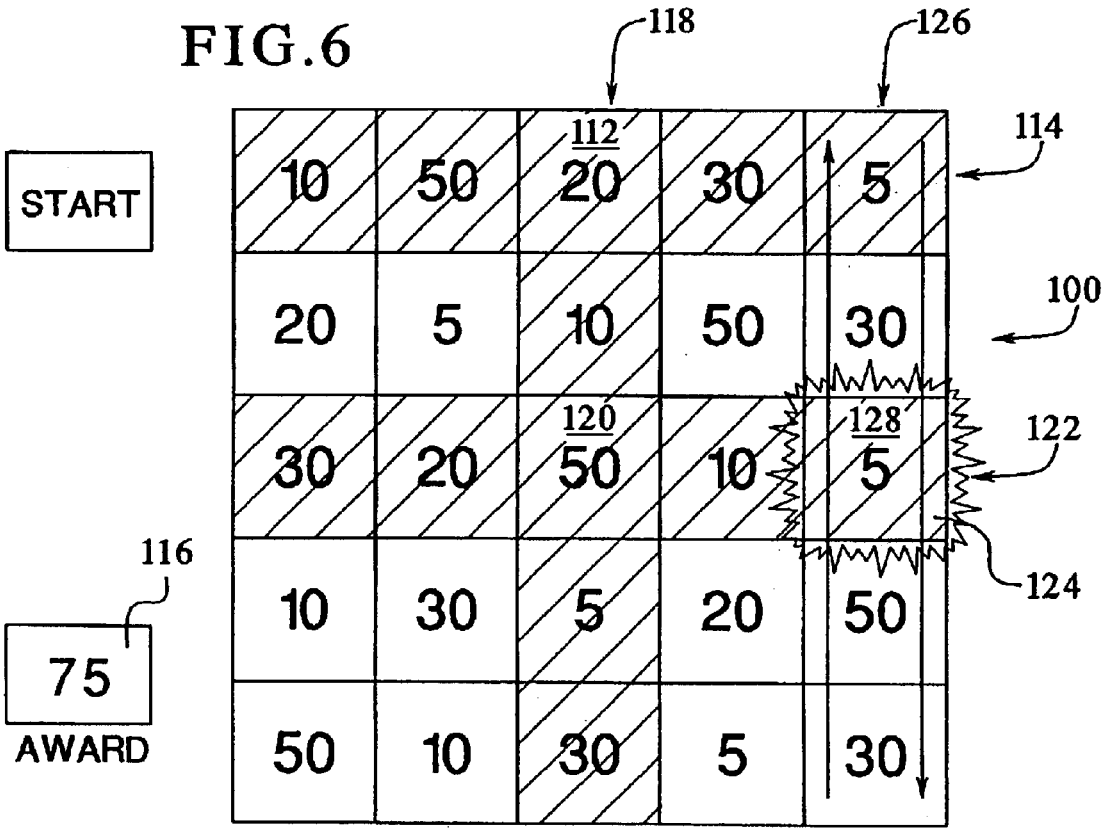
FIG. 6 is a top plan view of the grid of FIG. 3 upon the termination of the bonus round.
Figure 7:
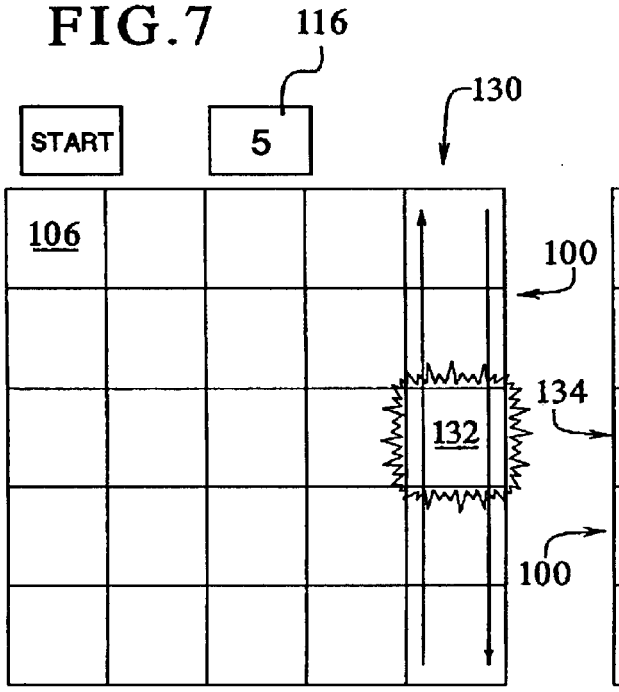
FIG. 7 is a top plan view of the grid of another embodiment of the bonus scheme of the present invention after the random selection of an award from a first selected column.

The second row 122 is spent and marked as illustrated in FIG. 6. The game continues by making a series of passes along a second column 126 to randomly select a position of the second column 126. The second column 126 includes the previously selected position 124 of the second row 122. As further illustrated in FIG. 6, the game ends because the selected and highlighted position 128 was a marked or spent position, i.e., the selected position 128 is from a marked row 122. The selected bonus value is not added to the cumulative bonus value total. Therefore, the bonus round ends with a cumulative bonus value or award of 75 as further illustrated in FIG. 6.

In another embodiment of the present invention as shown in FIGS. 7 to 10, the bonus round randomly selects a bonus award by performing the same sequencing as detailed above for the previously described bonus round. At game initiation, the bonus award or value that corresponds to each position 106 of the grid 100 are masked or not displayed as further illustrated in FIG. 7. The game performs a series of passes along a column 130 to randomly select a position 132 and award the bonus value which corresponds or is associated with the selected position 132. When the position 132 is selected, all of the bonus values of the column that contains the selected position 132 are displayed or unmasked and the entire column is visually marked as further illustrated in FIG. 8.

Figure 8:
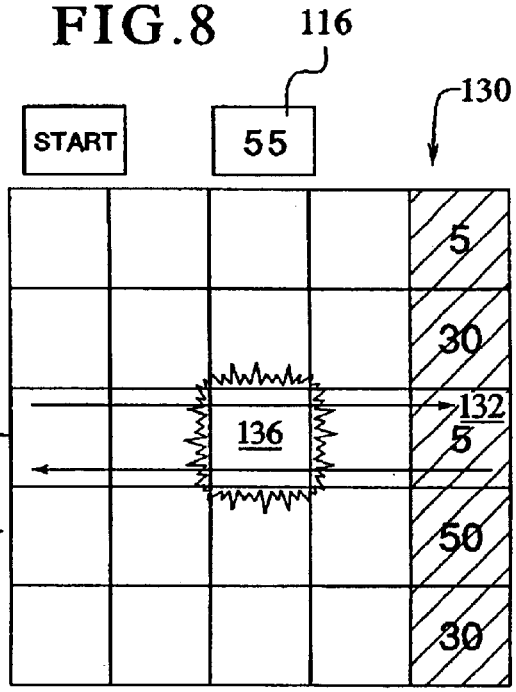
FIG. 8 is a top plan view of the grid of FIG. 7 after the random selection of an award from the first selected row.
Figure 9:
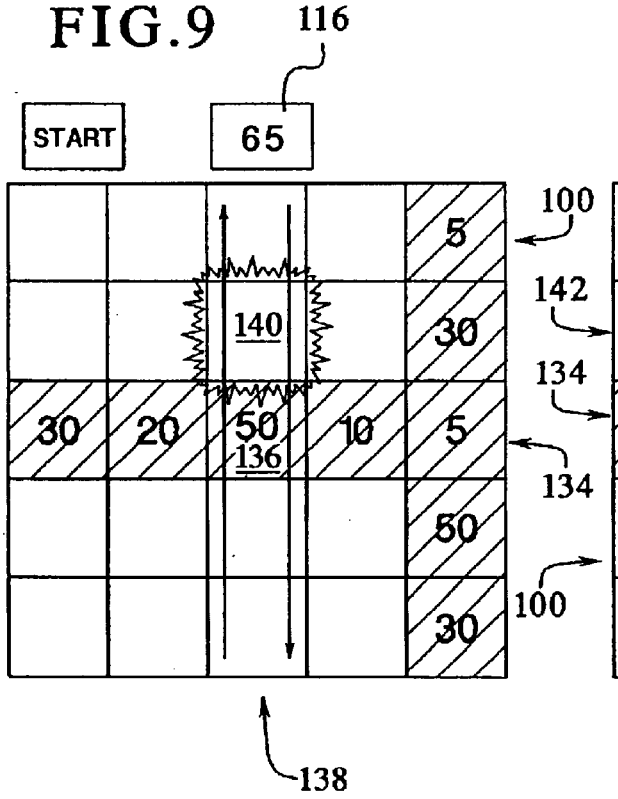
FIG. 9 is a top plan view of FIG. 7 of the present invention after the random selection of an award from the second selected column.

The bonus round continues and makes a series of passes along the row 134 which includes the previously selected position 132 as illustrated in FIG. 8. A position 136 along, this row 134 is randomly selected and its corresponding bonus value of 50 is added to the previously awarded bonus value of 5 for a cumulative total of 55 and displayed in the award display 116 as illustrated in FIGS. 8 and 9. All of the bonus values of this row 134 are displayed and the entire row 134 is visually marked as further illustrated in FIG. 9.

Figure 10:
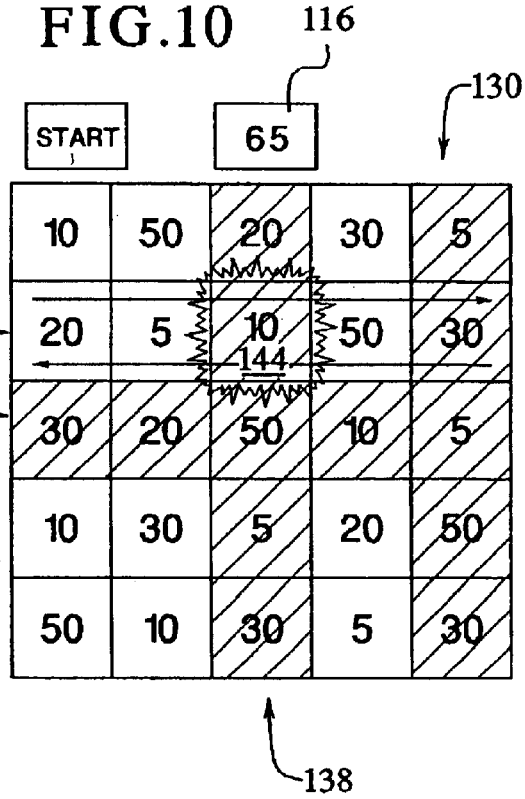
FIG. 10 is a top plan view of the grid of FIG. 7 of the present invention upon termination of the bonus round.

The bonus round continues to the next selection sequence by making a series of passes along the column 138 that contains the previously selected position 136. The next position 140 is randomly selected and its corresponding bonus value of 10 is added to the previous cumulative bonus value total of 55 for a new cumulative total of 65 as displayed in the award display 116 as illustrated in FIGS. 9 and 10. This column 138 is marked and all of its bonus values are revealed or unmasked as illustrated in FIG. 10.

The bonus round continues to the next selection sequence by making a series of passes along the row 142. As further illustrated in FIG. 10, the game ends because a position 144 of the marked column 138 was selected. The bonus award or value of this selected position 144 is not added to the cumulative bonus value total, and therefore, the cumulative bonus value total for this bonus round is 65 as displayed in the award display 116.

Figure 13:
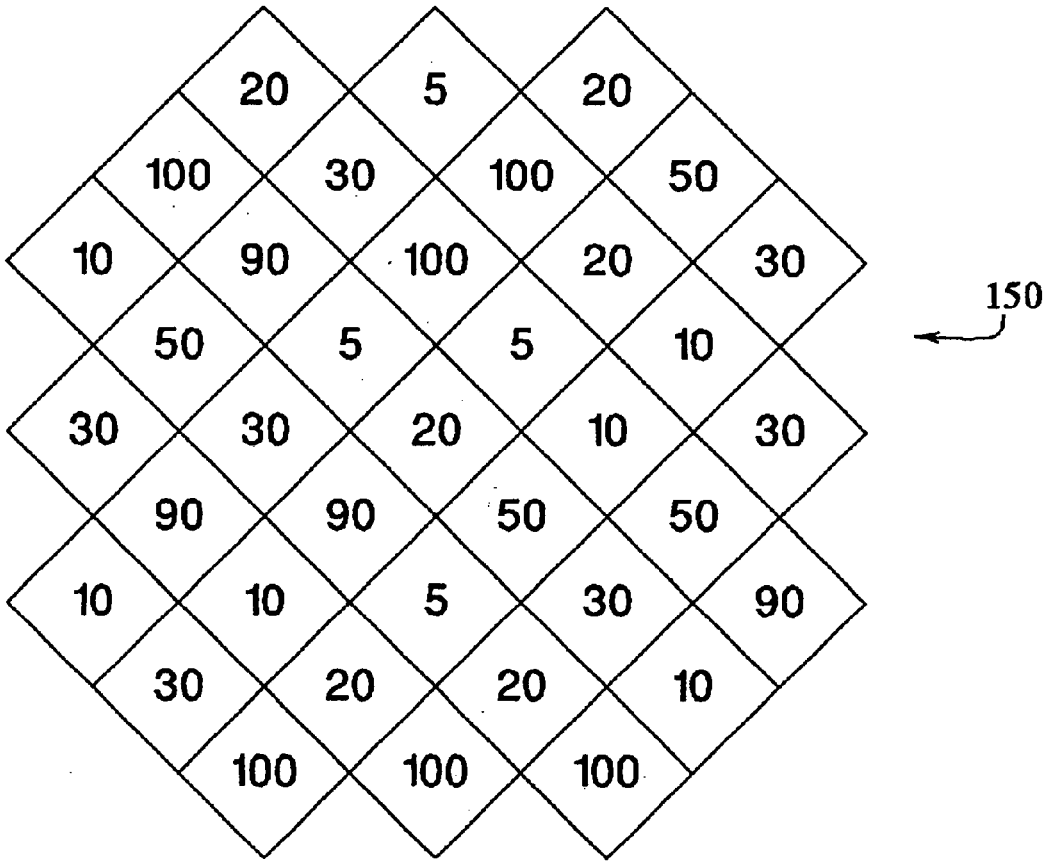
FIG. 13 is a top plan view of another embodiment of the grid display of the bonus scheme of the present invention.

The present invention is not limited to a square or rectangular-shaped grid as detailed above. A variety of different grid shapes may be utilized to facilitate and enhance the enjoyment and entertainment objectives of the present invention. For example, a cross-shaped grid 146 may be employed as illustrated in FIG. 11. In FIG. 12, a square-shaped grid 148 that is missing an L-shaped section is another example of a grid shape that may be utilized. In FIG. 13, a polygonal-shaped grid 150 is further illustrated.

Figure 14:
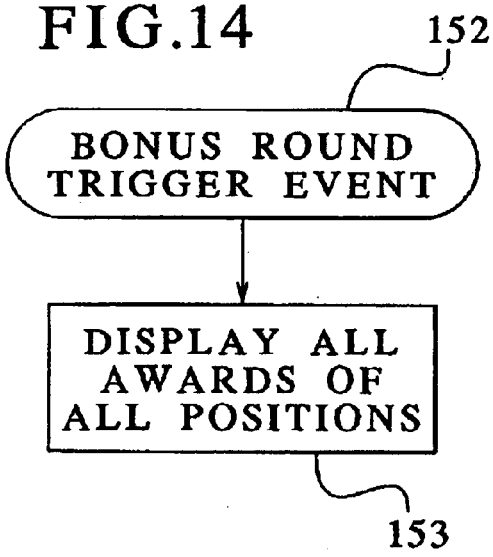
FIGS. 14 to 20 are flow diagrams of an embodiment of an award selection sequencing for the bonus scheme that employs a grid of the present invention.

As illustrated in FIGS. 14 to 20, a variety of different sequences may be utilized to randomly select a bonus award or value from a grid configuration. As indicated in circle 152, a bonus triggering event is the first step of each bonus round. As discussed above, the bonus triggering event occurred when the player depressed the start button. However, the bonus triggering event is not limited to this event and can include a variety of different events. For example, the game can initiate or activate the bonus round without any interaction from the player and can continue to play the bonus round until the game ends without further player interaction as illustrated in FIG. 14 as indicated in box 153.

Figure 15:
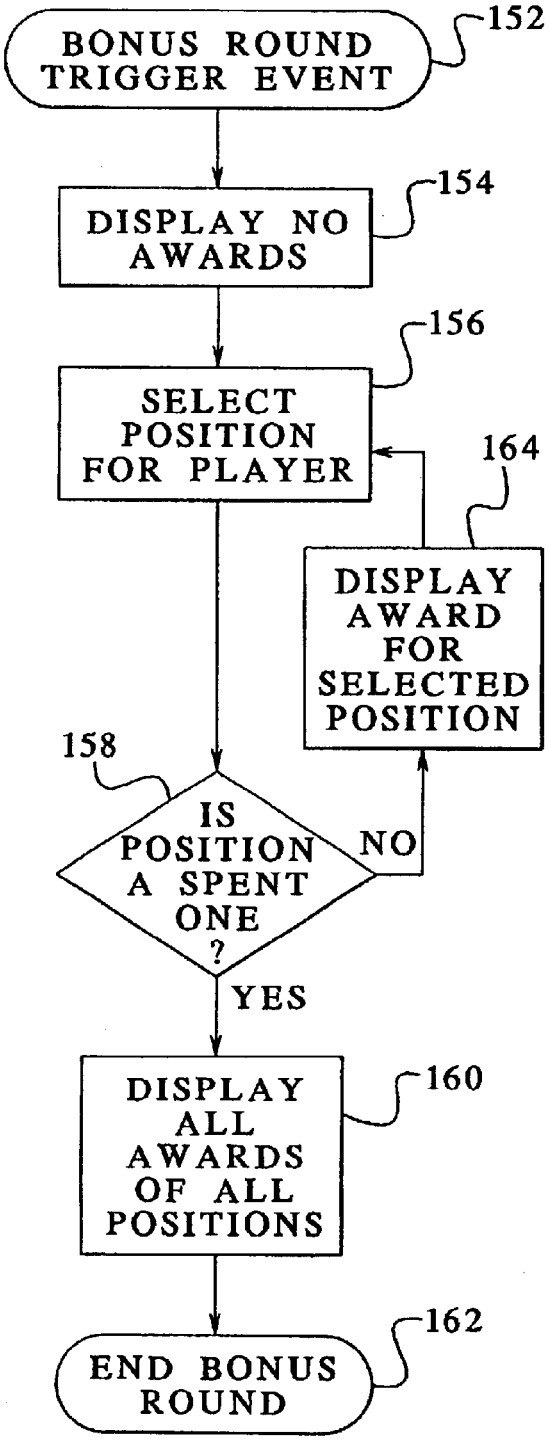

In FIG. 15, the bonus awards are not displayed after the bonus triggering event as indicated in box 154. A position is randomly selected as indicated in box 156. If the selected position is a spent, exhausted or eliminated position as indicated in diamond 158, then the bonus values for each of the corresponding selected positions are displayed as further indicated in box 160, and the bonus round ends as shown in circle 162. If the selected position is not spent as indicated in diamond 158, then the bonus value that corresponds to or is associated with the selected position is displayed and another position is selected as further indicated in boxes 164 and 156. These steps are repeated until a selected position is a terminating position, i.e., spent or exhausted. Thereafter, the game ends.

Figure 16:
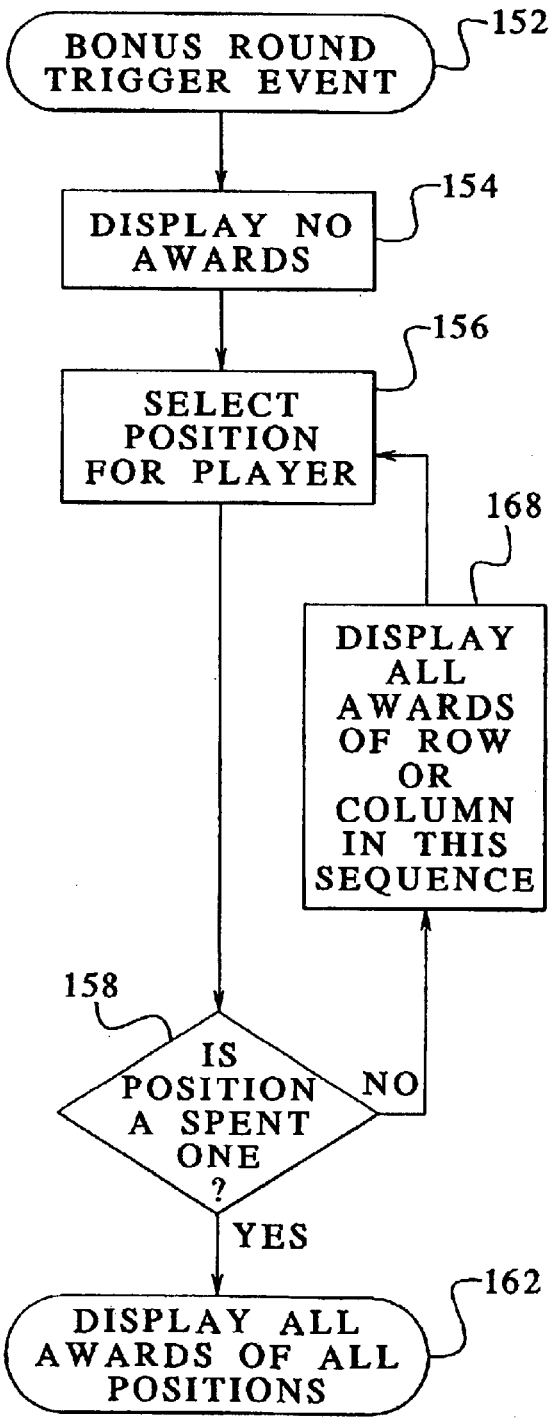

As illustrated in FIG. 16, the sequence of events are identical to those of FIG. 15 except that the bonus value or award is displayed for each of the positions of the row or column from which a position is selected as indicated in box 168.

Figure 17:
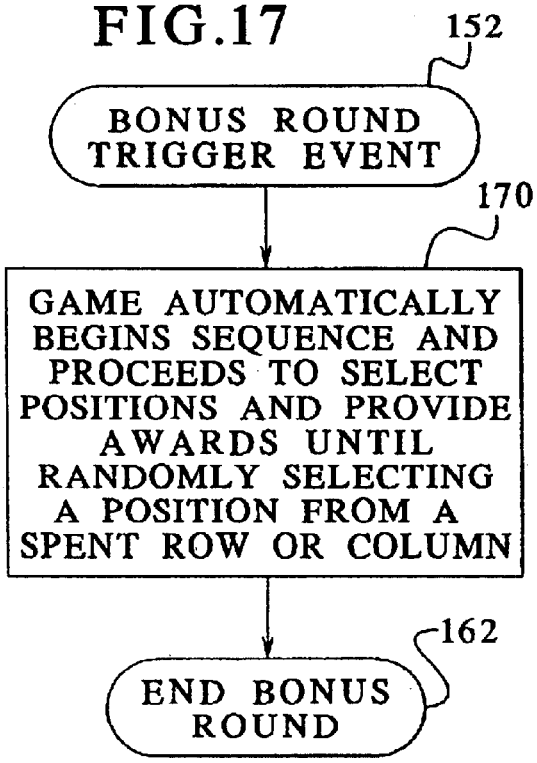

In FIG. 17, the game automatically begins the sequence and proceeds to select positions and provide awards until the game randomly selects a position from a spent row or column as indicated in box 170. Thereafter, the game ends as further indicated in circle 162.

Figure 18:
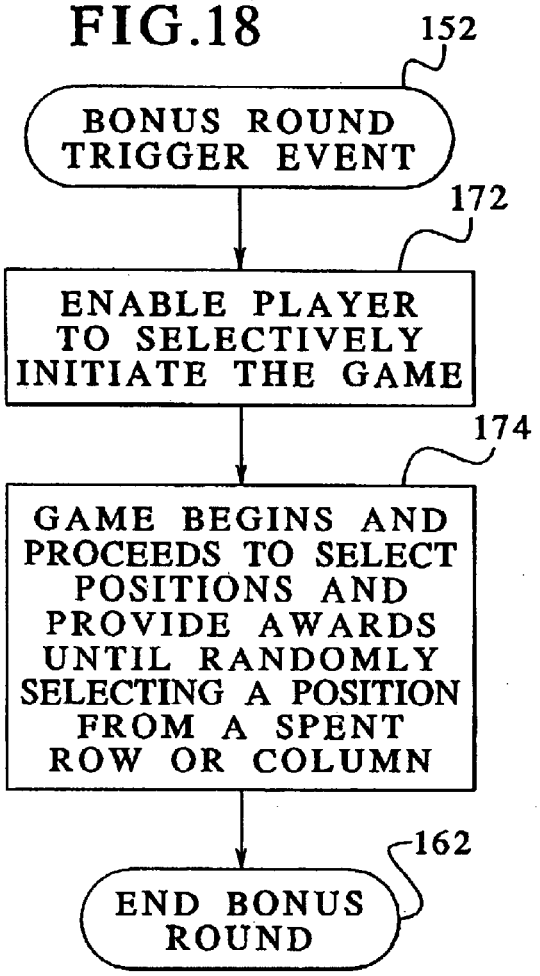
Figure 19:
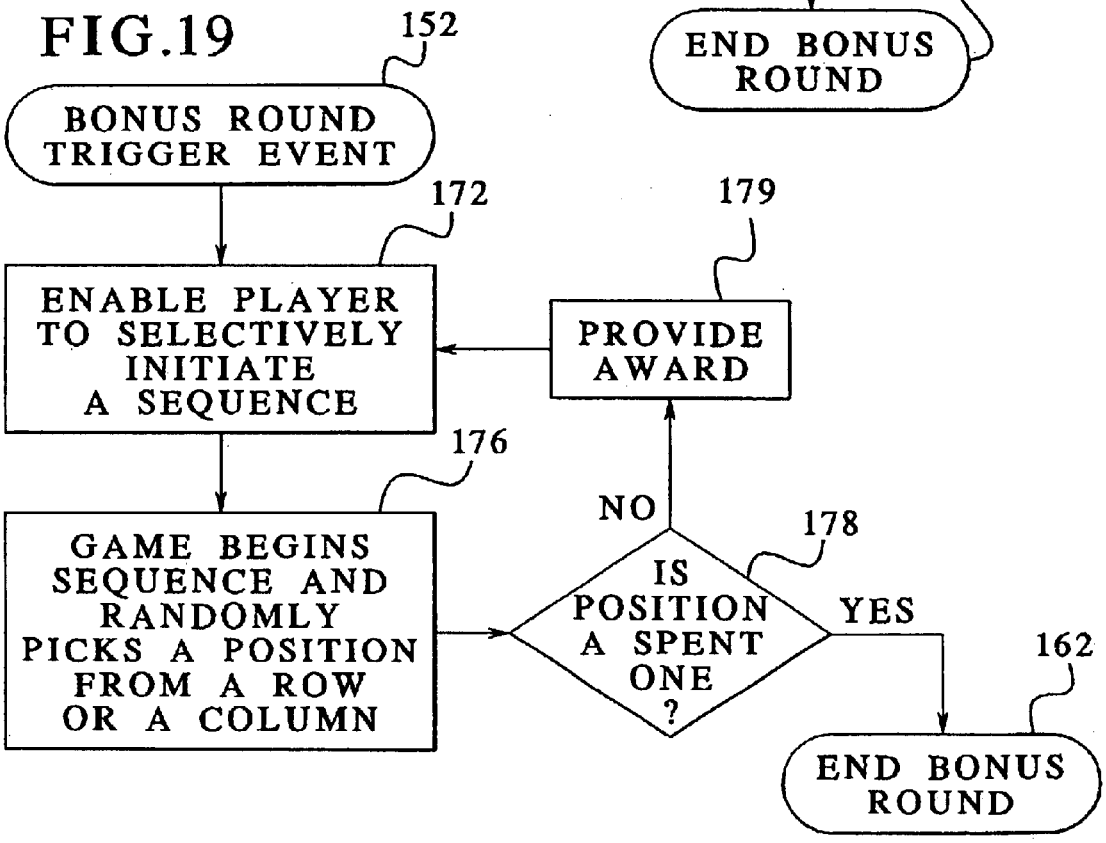

In FIG. 18, the game enables the player to selectively initiate the game, as indicated by box 172. Once initiated, the sequence begins and randomly picks or selects a position from a row or column and provides an award until randomly selecting a position from a spent row or column, i.e., selecting a terminating position as indicated in box 174. Thereafter, the game ends as further indicated in circle 162. In FIG. 19, the game enables the player to initiate a sequence as indicated in box 172. Once initiated, the sequence begins and randomly picks a position from a row or column as indicated in box 176. If the position is not spent, then an award is provided and the selection sequence is repeated as indicated in diamond 178 and box 179. If the position is spent, then the game ends as further indicated in diamond 178 and circle 162.

Figure 20:
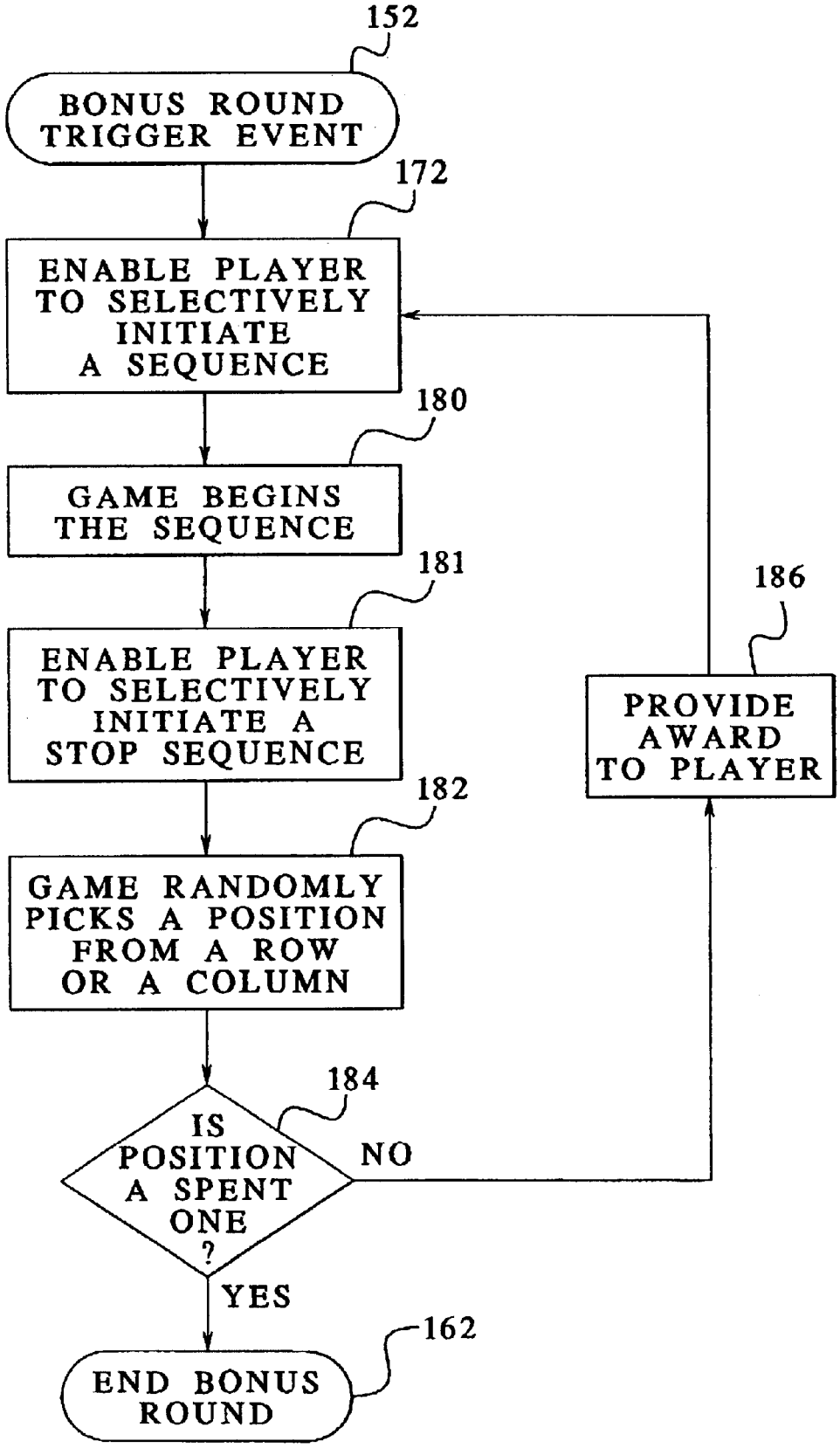

In FIG. 20, the game enables the player to selectively initiate a sequence, as indicated in box 172. Once initiated, the game begins the sequence and enables the player to selectively initiate a stop sequence as indicated in boxes 180 and 181. The game randomly selects a position in response to the stop sequence as indicated in box 182. If the position is not spent, then an award is provided and the selection sequence is repeated as indicated in diamond 184 and box 186. If the position is spent, then the bonus round ends as further indicated in diamond 184 and circle 162.

As previously discussed, the present invention is not limited to a bonus round that employs a grid configuration. The present invention includes a bonus round configuration having a plurality of groups that each contain a number of elements. The plurality of groups and elements are related in such a way that the bonus round has a decreasing chance of generating an award for the player with each successive random selection of an element from a group.

Figure 21:
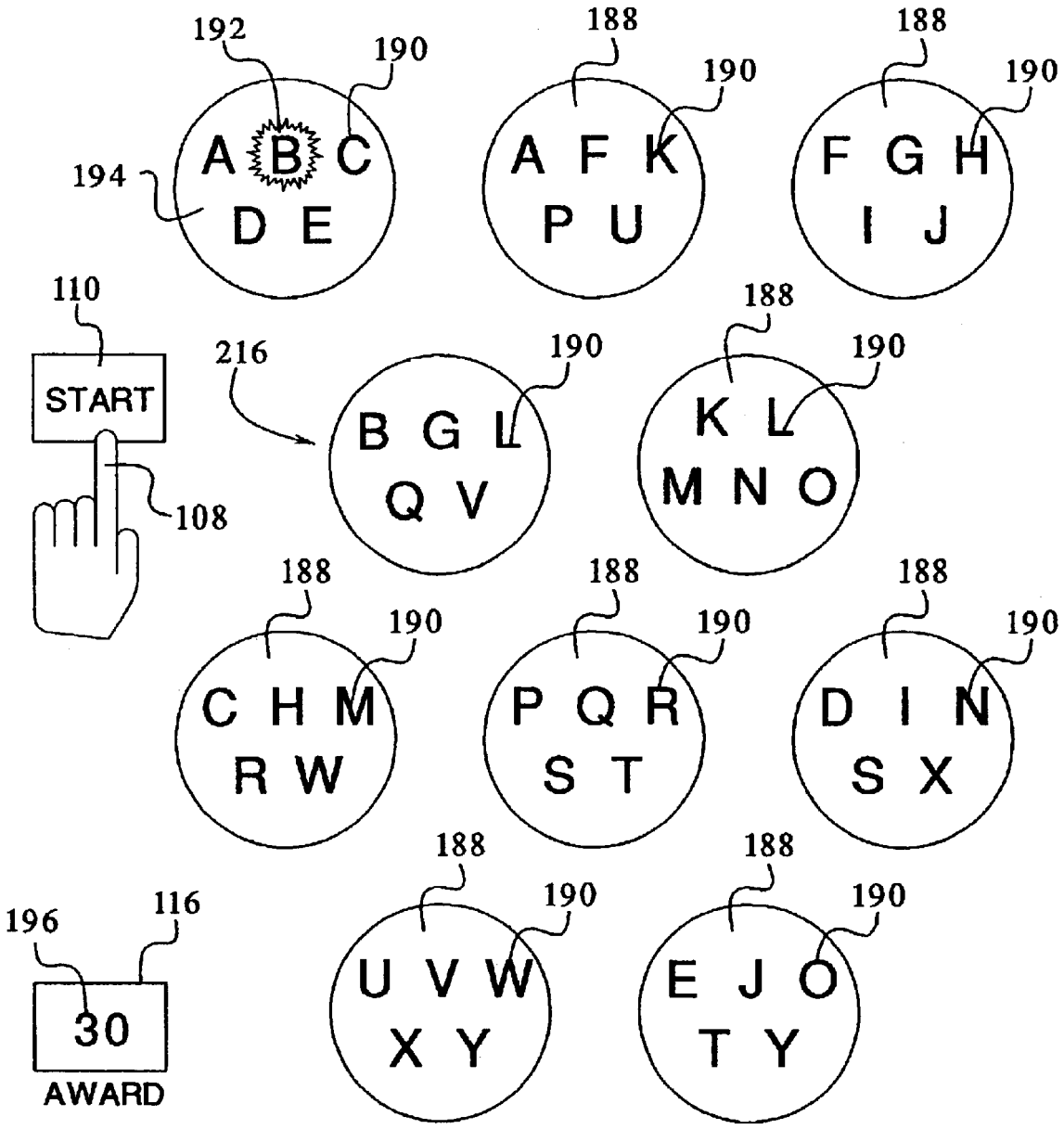
FIG. 21 is a top plan view of another embodiment of the bonus scheme of the present invention illustrating a plurality of groups of elements.
Figure 22:
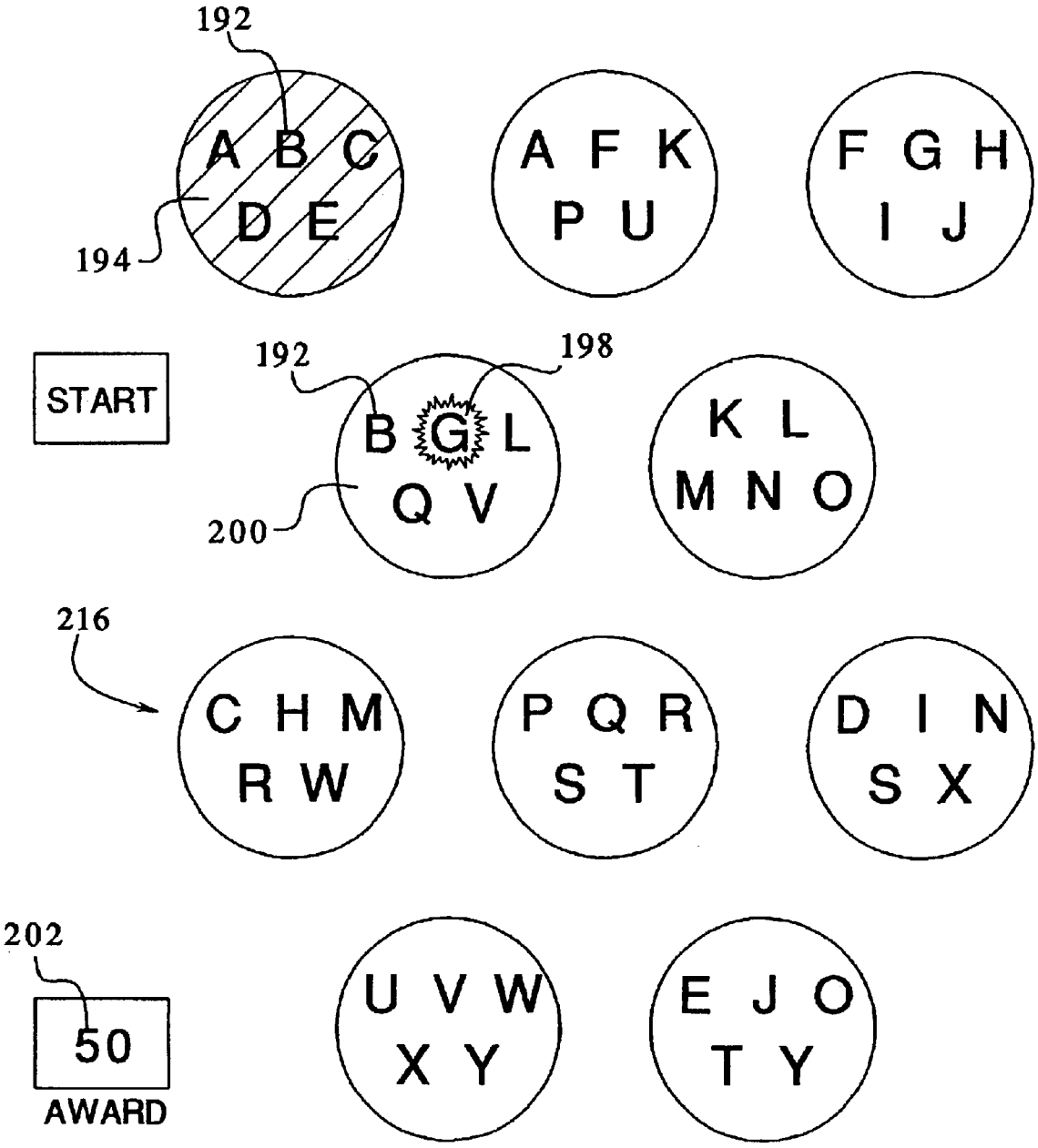
FIG. 22 is a top plan view of the groups of FIG. 21 of the present invention after the random selection of an award from a second selected group.

In an alternative embodiment, the groups 188 and elements 190 of the bonus scheme are configured as illustrated in FIGS. 21 to 24. As illustrated in FIG. 21, the bonus round begins when the player 108 depresses the start button. The game randomly selects an element 192 from a group 194 and awards a bonus value 196 that corresponds to or is associated with the selected element 192, i.e., a bonus value of 30 as displayed in the award display 116 of FIG. 21. Once the element 192 is selected, the entire group 194 specifically including the elements of the group that contains this element 192 is spent or exhausted and visually marked as indicated in FIG. 22. If another group containing any of the elements of the group is selected, the game terminates as discussed below.

The bonus round continues and randomly selects an element 198 from another group 200 that also includes the element 192 that was previously selected as further illustrated in FIG. 22. In other words, because the "B" was selected in the first group, the next element is randomly selected from another group which includes the "B". If the "B" element is again randomly selected, the game ends because the "B" and the other elements (i.e., A, C, D and E in the group) are exhausted or eliminated. Once the element 198 is selected, a bonus value of 20 (not shown) that corresponds to this element 198 is added to the previous bonus value of 30 for a cumulative bonus value total 202 of 50. The entire group 200 including the elements in the group that contains this newly selected element 198 also is spent and visually marked as illustrated in FIG. 23.

Figure 23:
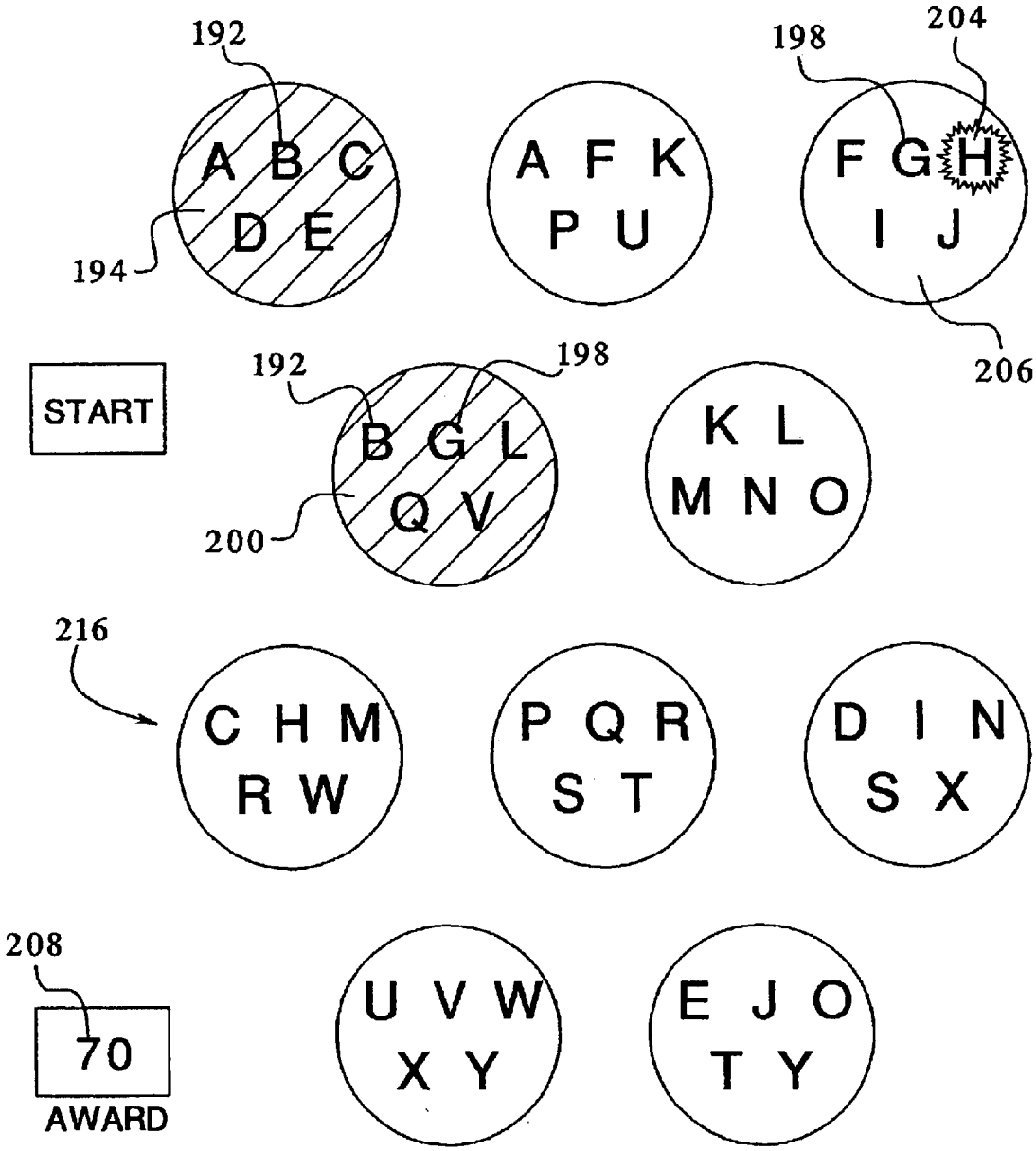
FIG. 23 is a top plan view of the groups of FIG. 21 of the present invention after the random selection of an award from a third selected group.

The bonus round continues and randomly selects an element 204 from another group 206 that also contains the previously selected element 198 as further illustrated in FIG. 23. The newly selected element 204 is highlighted and its corresponding bonus value of 20 (not shown) is awarded and added to the cumulative bonus value total 202 for a new cumulative bonus value total 208 of 70. The entire group 206 that includes the newly selected element 204 is spent and visually marked as illustrated in FIG. 24.

Figure 24:
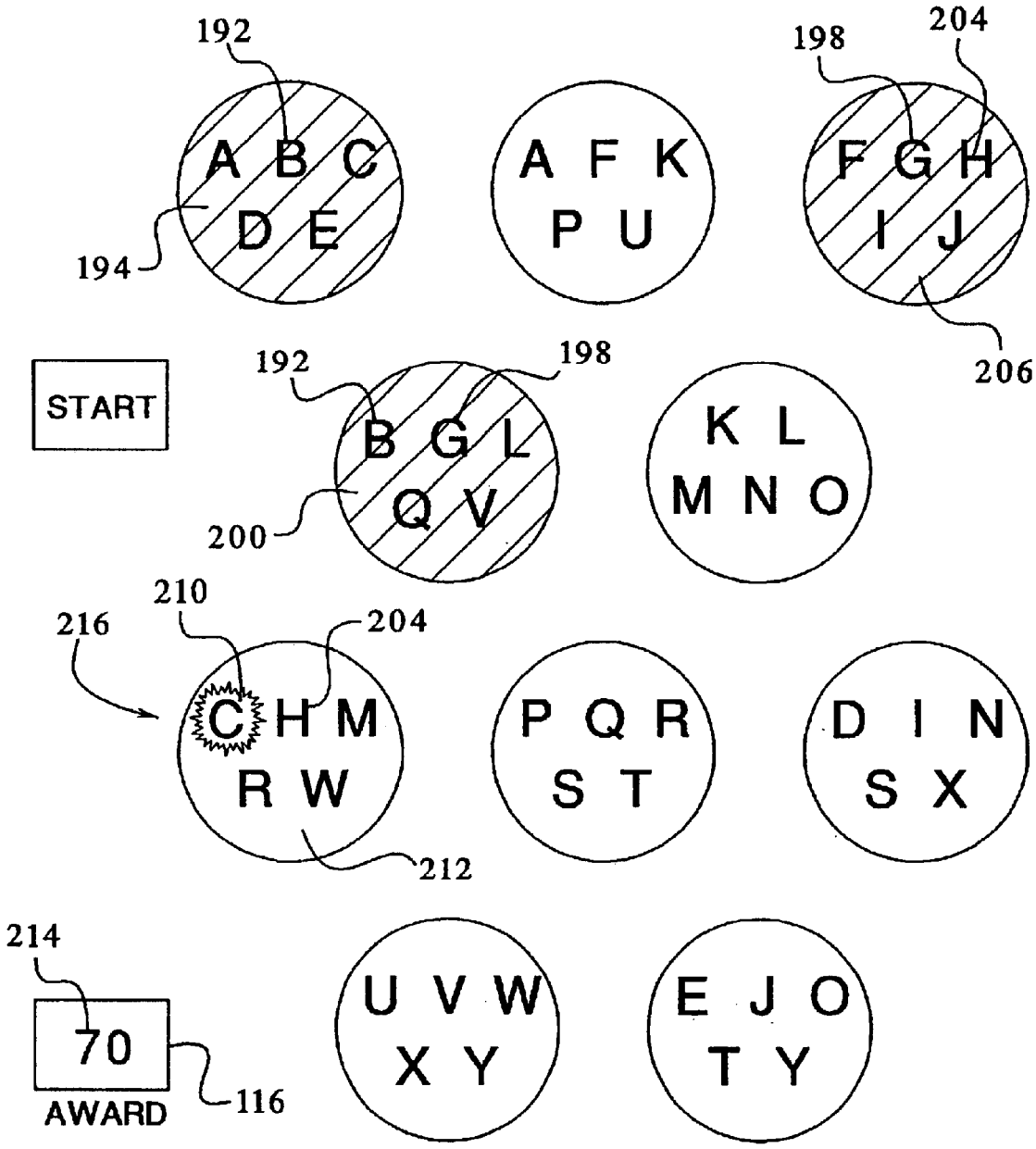
FIG. 24 is a plan view of the groups of FIG. 21 of the present invention upon the termination of the bonus round.

The bonus round continues and randomly selects an element 210 from another group 212 that also contains the previously selected element 204 as further illustrated in FIG. 24. However, the game ends because the selected element 210 is a terminating element, i.e., an element from the spent or eliminated group 194 as visually marked in FIG. 24. The bonus value (not shown) that corresponds to this element 210 is not added to the cumulative bonus value total. Thus, the bonus value total 214 is 70 at the end of the game as displayed in the award display 116.

Although the groups are illustrated by a circular boundary 216 as illustrated in FIGS. 21 to 24, the present invention is not limited to any particular group display. The group display can be defined by a variety of different boundary shapes, sizes, dimensions and configurations or be hidden from the player. For example, the group boundary can include a square, rectangular, triangle, or other like boundary shapes.

The present invention is not limited to the element display as further illustrated in FIGS. 21 to 24. The elements are represented by letter symbols, such as, A, B, C, etc., as further illustrated in FIGS. 21 to 24. However, the elements can be represented by a variety of different symbols, such as, numbers, characters, figures, or other like symbols.

Figure 25:
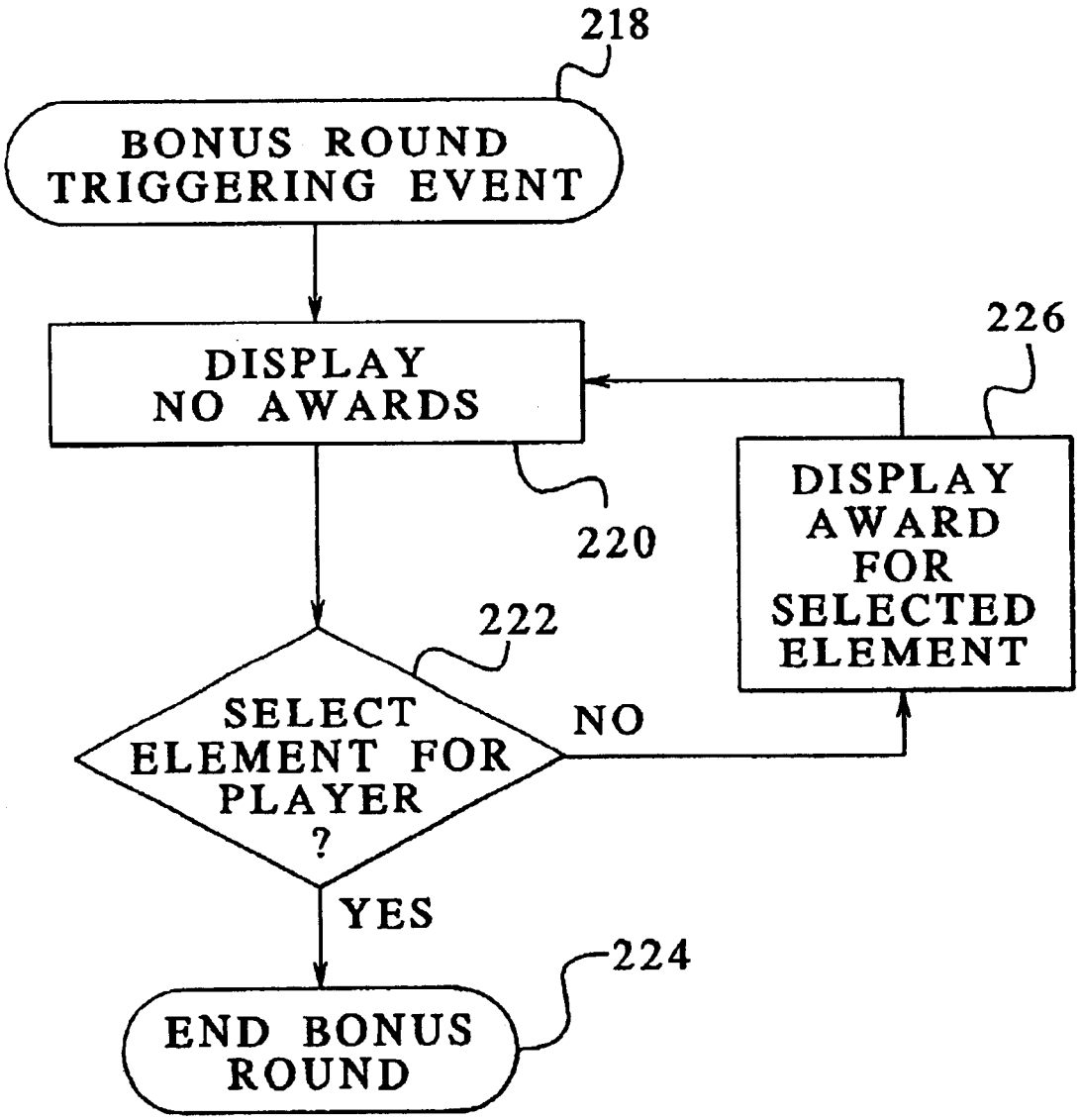
FIG. 25 is a flow diagram of another embodiment of the bonus scheme of the present invention.

The present invention may include a variety of different sequencing events to randomly select a bonus award that corresponds to an element of a group as illustrated above. For example, the bonus round triggering event is the first event or sequence of the bonus round as illustrated in circle 218 of FIG. 25 and further detailed above. The bonus awards or values for each of the elements are not displayed at game initiation as indicated in box 220. An element is randomly selected. If the element is from a spent or marked group, then the game ends as shown in diamond 222 and circle 224. If the element is not from a spent or marked group, then an award is displayed that corresponds to a bonus value associated with the selected element as indicated in box 226. Another element is randomly selected and its corresponding bonus award or value is added to the current bonus value total and displayed as a new cumulative bonus value total. The bonus round continues to select elements and cumulatively award bonus values until an element is selected from a marked or spent group.

The present invention is not limited to the sequencing of events as previously discussed and can include any number and variety of different and suitable sequences in order to facilitate excitement and entertainment for the player. For example, the bonus round may include a risk sequence where the player can risk the award prior to the next selection of an element. If the player risks the award and the next selected element is not previously marked or eliminated, the game continues and provides the player with a higher award. The higher award is greater than the award (i.e., the award associated with the cumulatively awarded bonus values) which the player would have received if the risk had not been taken.

However, if the player risks the award and the next selected element is a marked or eliminated element, the game ends and provides the player with a consolation award equaling in value less than the value of the award (i.e., the award associated with the cumulatively awarded bonus values) if the risk had not been taken.

The player has the opportunity to risk the award before any or all of the selections of the next selected elements. However, if the player chooses not to risk the award, the game provides the award as previously discussed, that is, the player receives an award associated with the cumulatively awarded bonus values that equals, for example, the sum total of bonus values cumulatively awarded at that stage in the bonus round.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device for playing a game comprising:

a display device adapted to display the game;

a plurality of elements in the game;

a plurality of element groups in the game, wherein each element group includes one of said elements and each of a plurality of the element groups includes a plurality of said elements;

a plurality of values in the game, wherein each value is associated with one of said elements; and a processor operable with said display device to control the play of the game by causing and displaying a selection of one of the elements from one of said element groups, providing a player the value associated with said selected element, eliminating said element group that includes the previously selected and displayed element, causing and displaying a selection of one of said elements from another one of said element groups which includes at least one element from the previously eliminated element group and providing the player the value associated with the selected element if said element is not in a previously eliminated element group.

2. The gaming device of claim 1, wherein each element group includes a plurality of said elements.

3. The gaming device of claim 1, wherein the other element group includes at least the previously selected element.

4. The gaming device of claim 1, wherein said processor is operable to control the play of the game by providing the player the value associated with the selected element if said element is not one of said previously selected elements.

5. The gaming device of claim 1, wherein said processor is operable to control the play of the game by providing the player the value associated with each selected element.

6. The gaming device of claim 1, wherein said element groups are arranged on a grid configuration.

7. The gaming device of claim 6, wherein said element groups are a plurality of rows and a plurality of columns of said grid configuration.

8. The gaming device of claim 1, wherein said processor and display device are operable to control the play of the game by displaying the value associated with each of the selected elements.

9. The gaming device of claim 1, wherein said processor and display device are operable to control the play of the game by displaying the value associated with each of the elements from at least one element group.

10. The gaming device of claim 1, wherein said processor and display device are operable to control the play of the game by displaying the value associated with each of the elements from each previously eliminated element group.

11. The gaming device of claim 1, wherein said processor and display device are operable to control the play of the game by displaying the value associated with each of the elements from each element group.

12. A gaming device operable under the control of a processor, said gaming device comprising:

a display device operable with said processor;

a primary wagering game adapted to be displayed by said display device, wherein said primary wagering game is operable upon a wager by a player;

a secondary same adapted to be displayed by said display device;

a plurality of elements in the secondary game;

a plurality of values in the secondary game, wherein each value is associated with at least one of said elements;

a plurality of element groups in the secondary game, wherein each element group includes at least one of the elements and each of a plurality of the element groups each includes a plurality of said elements; and a triggering event adapted to occur and be displayed in said primary wagering game, wherein after the occurrence of said triggering event, the processor causes the secondary game to be played, wherein in the secondary game: one of said elements from one of said element groups is selected and displayed, any value associated with said selected element is provided to the player, the element group that includes the previously selected and displayed element is eliminated, one of said elements from another one of said element groups is selected and displayed wherein the other element group includes at least one element from the previously eliminated element group and any value associated with the selected element from the other element group is provided to the player if said selected element is not in a previously eliminated element group.

13. The gaming device of claim 12, wherein each element group includes a plurality of said elements.

14. The gaming device of claim 12, wherein the other element group includes at least the previously eliminated element.

15. The gaming device of claim 12, wherein the value associated with the selected element from the other element group is provided to the player if said selected element is not one of said previously selected elements.

16. The gaming device of claim 12, wherein the value associated with each of the selected elements is displayed to the player.

17. The gaming device of claim 12, wherein the value associated with each of the elements from at least one element group is displayed to the player.

18. The gaming device of claim 12, wherein the value associated with each of the elements from each previously eliminated element group is displayed to the player.

19. The gaming device of claim 12, wherein the value associated with each of the elements from each element group is displayed to the player.

20. A gaming device for playing a game comprising:

a display device adapted to display the game;

a plurality of elements in the game, wherein a plurality of said elements are different;

a plurality of awards in the game, wherein a plurality of said awards are associated with said plurality of elements;

a plurality of different element groups in the game, wherein a plurality of the element groups each includes a plurality of said elements; and a processor operable with said display device to control the play of the game by causing and displaying a selection and elimination of at least one of said elements from one of said element groups, causing and displaying a selection and elimination of at least one different element from another one of said element groups wherein the other element group includes said immediate previously selected and displayed element, causing and displaying another selection and elimination of at least one different element from another one of said element groups wherein the other element group includes said immediate previously selected and displayed element if the different element is not included in one of said element groups which includes one of said previously eliminated elements other than the immediate previously eliminated element and providing a player an award based on at least one of said selected elements.

21. The gaming device of claim 20, wherein each element group includes a plurality of said elements.

22. The gaming device of claim 20, wherein said processor is operable to control the play of the game by providing the player the award associated with each of the selected elements.

23. The gaming device of claim 20, wherein said processor is operable to control the play of the game by providing the player the award associated with each of said selected elements except the selected element which is an element in one of the groups of elements that includes one of said previously eliminated elements.

24. The gaming device of claim 20, wherein said processor and display device are operable to control the play of the game by displaying the award associated with each of the selected elements.

25. The gaming device of claim 20, wherein said processor and display device are operable to control the play of the game by displaying the award associated with each of the elements from at least one element group.

26. The gaming device of claim 20, wherein said processor and display device are operable to control the play of the game by displaying the award associated with each of the elements from each element group.

27. The gaming device of claim 20, wherein said processor and display device are operable to control the play of the game by eliminating each of the elements in the element group which includes the selected element.

28. The gaming device of claim 20, wherein the elements are arranged as positions on a grid.

29. The gaming device of claim 28, wherein the element groups are a plurality of rows and a plurality of columns of said grid.

30. A gaming device operable under the control of a processor, said gaming device comprising:

a display device operable with said processor;

a primary wagering game adapted to be displayed by said display device, wherein said primary wagering game is operable upon a wager by a player;

a secondary same adapted to be displayed by said display device;

a plurality of elements in the secondary game, wherein a plurality of said elements are different;

a plurality of awards in the secondary game, wherein a plurality of said awards are associated with said plurality of elements;

a plurality of different element groups in the secondary game, wherein a plurality of the element groups each includes a plurality of said elements; and a triggering event adapted to occur and be displayed in said primary wagering game, wherein after the occurrence of said triggering event, the processor causes the secondary game to be played, wherein in the secondary game: at least one of said elements from one of said element groups is selected, displayed and eliminated, at least one different element from another one of said element groups which includes said immediate previously selected and displayed element is selected, displayed and eliminated if the different element is not included in one of said element groups which includes one of said previously eliminated and displayed elements other than the immediate previously eliminated and displayed element and at least one of the awards associated with a plurality of said selected and displayed elements are provided to the player.

31. The gaming device of claim 30, wherein each different element group includes a plurality of said elements.

32. The gaming device of claim 30, wherein the award associated with each of the selected elements is provided to the player.

33. The gaming device of claim 30, wherein the award associated with each of said selected elements is provided to the player except the selected element which is an element in one of the groups of elements that includes one of the previously eliminated elements.

34. The gaming device of claim 30, wherein the award associated with each of the selected elements is displayed to the player.

35. The gaming device of claim 30, wherein the award associated with each of the elements from at least one element group is displayed to the player.

36. The gaming device of claim 30, wherein the award associated with each of the elements from each element group is displayed to the player.

37. The gaming device of claim 30, wherein each of the elements in the element group which includes the selected element are eliminated.

38. A gaming device for playing a game comprising:

a display device adapted to display the game;

a plurality of elements in the game;

a plurality of values in the game, wherein each value is associated with at least one of said elements;

a plurality of element groups in the game, wherein a plurality of the element groups each includes a plurality of said elements; and a processor operable with said display device to control the play of the game by displaying said plurality of element groups, causing and displaying a selection and elimination of one of said elements from one of said element groups, providing a player any value associated with said selected element, causing and displaying a selection and elimination of one of said elements from another one of said element groups which includes said previously selected and displayed element if said element is not one of said eliminated elements and providing the player any value associated with said other selected element if said other selected element is not in one of said element groups having one of said eliminated elements.

39. The gaming device of claim 38, wherein said processor and the display device are operable to control the play of the game by marking each element in the element group that includes the selected element.

40. The gaming device of claim 39, wherein said processor and the display device are operable to control the play of the game by causing the selection of said other element if said previously selected element is not in one of said marked element groups.

41. A gaming device operable under the control of a processor, said gaming device comprising:

a display device operable with said processor;

a primary wagering game adapted to be displayed by said display device, said primary wagering game operable upon a wager by a player;

a secondary game adapted to be displayed by said display device;

a plurality of elements in the secondary game;

a plurality of values in the secondary game, wherein each value is associated with at least one of said elements;

a plurality of element groups in the secondary game, wherein a plurality of the element groups each includes a plurality of said elements; and a triggering event adapted to occur and be displayed in said primary wagering game, wherein after the occurrence of said triggering event, the processor causes the secondary game to be played, wherein in the secondary game: the plurality of element groups are displayed to the player, one of said elements from one of said element groups is selected, displayed and eliminated, any value associated with said selected element is provided to the player, another one of said elements from another one of said element groups which includes said previously selected and displayed element is selected and displayed if said element is not one of said eliminated elements and any value associated with said other selected element is provided to the player if said other selected element is not included in one of said element groups having one of said eliminated elements.

42. The gaming device of claim 41, each element in the element group that includes the selected element is marked.

43. The gaming device of claim 42, wherein said other element is selected if said previously selected element is not in one of said marked element groups.

44. A gaming device controlled by a processor for playing a game, said gaming device comprising:

a display device operable with said processor and adapted to display the game;

a plurality of elements in the game;

a plurality of values in the game, wherein each value is associated with at least one of said elements;

a plurality of element groups in the game, wherein a plurality of the element groups each includes a plurality of said elements;

an initial sequencing event in the game, wherein said initial sequencing event causes and displays the selection of one element from one of said element groups and eliminates the selected element;

a plurality of successive sequencing events in the game, wherein each successive sequencing event causes and displays the selection of one element from one of said element groups which includes the previously selected element and eliminates the selected element; and a triggering event adapted to occur and be displayed in said game, wherein after the occurrence of said triggering event, the processor causes the game to be played, wherein in the game: an activation of said initial sequencing event occurs, the value associated with the element selected in the initial sequencing event is provided to the player, an activation of at least one of said successive sequencing events occurs and the value associated with the element selected in each successive sequencing event is provided to the player unless said element selected in the successive sequencing event is a previously eliminated element.

45. The gaming device of claim 44, wherein the initial sequencing event eliminates each element in the element group including the selected element.

46. The gaming device of claim 44, wherein each successive sequencing event eliminates each element in the element group including the selected element.

47. The gaming device of claim 44, wherein the said initial sequencing event is player activated.

48. The gaming device of claim 44, wherein at least one of said successive sequencing events is player activated.

49. The gaming device of claim 44, wherein each successive sequencing event is player activated.

50. The gaming device of claim 44, the value associated with the element selected in each of the successive sequencing events is provided to the player, unless the element selected in the successive sequencing event is in an element group which includes one of said previously eliminated elements.

51. A gaming device controlled by a processor for playing a game, said gaming device comprising:

a display device operable with said processor and adapted to display the game;

a plurality of elements in the game;

a plurality of values in the game, wherein each value is associated with at least one of said elements;

a plurality of element groups in the game, wherein a plurality of the element groups each includes a plurality of said elements;

an initial sequencing event in the game, wherein said initial sequencing event causes and displays the selection of one element from one of said element groups and eliminates the element group that includes said selected element;

a plurality of successive sequencing events in the game, wherein each successive sequencing event causes and displays the selection of one element from one of said element groups which includes the previously selected element and eliminates the element group that includes said selected element; and a triggering event adapted to occur and be displayed in said game, wherein after the occurrence of said triggering event, the processor causes the game to be played, wherein in the game: an activation of said initial sequencing event occurs, the value associated with the element selected in the initial sequencing event is provided to the player, an activation of at least one of said successive sequencing events occurs and the value associated with the element selected in each successive sequencing event is provided to the player if said selected element is not in one of said previously eliminated element groups.

52. The gaming device of claim 51, wherein the initial sequencing event eliminates each element in the element group including the selected element.

53. The gaming device of claim 51, wherein each successive sequencing event eliminates each element in the element group including the selected element.

54. The gaming device of claim 51, wherein said initial sequencing event is player activated.

55. The gaming device of claim 51, wherein at least one of said successive sequencing events is player activated.

56. The gaming device of claim 51, wherein each successive sequencing event is player activated.

* * * * *

UNITED STATES PATENT AND TRADEMARK OFFICE

CERTIFICATE OF CORRECTION

PATENT NO. : 6,802,775 B2
DATED : October 12, 2004
INVENTOR(S) : Anthony J. Baerlocher et al.

It is certified that error appears in the above-identified patent and that said Letters Patent is hereby corrected as shown below:

Column 1,
Line 29, change “same” to -- game --.

Signed and Sealed this

Thirtieth Day of August, 2005

JON W. DUDAS
*Director of the United States Patent and Trademark Office*